US009982215B2

(12) United States Patent
Amemiya et al.

(10) Patent No.: US 9,982,215 B2
(45) Date of Patent: May 29, 2018

(54) SOLID LUBRICANT, ELECTROPHOTOGRAPHIC IMAGE FORMING APPARATUS, AND IMAGE FORMING METHOD

(71) Applicant: Konica Minolta, Inc., Tokyo (JP)

(72) Inventors: Taiki Amemiya, Hachioji (JP); Yukio Hosoya, Tama (JP); Kunihiro Ogura, Hino (JP); Teruo Sasaki, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/432,252

(22) Filed: Feb. 14, 2017

(65) Prior Publication Data

US 2017/0275557 A1 Sep. 28, 2017

(30) Foreign Application Priority Data

Mar. 22, 2016 (JP) ..... 2016-056484

(51) Int. Cl.
*G03G 21/00* (2006.01)
*C10M 169/04* (2006.01)

(52) U.S. Cl.
CPC ..... *C10M 169/041* (2013.01); *G03G 21/0094* (2013.01); *C10M 2205/024* (2013.01); *C10M 2207/126* (2013.01); *C10N 2250/08* (2013.01)

(58) Field of Classification Search
CPC ..... C10M 169/041
See application file for complete search history.

(56) References Cited

U.S. PATENT DOCUMENTS

2008/0318148 A1* 12/2008 Sugimoto ..... G03G 9/0806 430/108.4

FOREIGN PATENT DOCUMENTS

JP 2007224137 A 9/2007

OTHER PUBLICATIONS

JP 2007-224137 English machine translation of Description.*

* cited by examiner

*Primary Examiner* — Walter L Lindsay, Jr.
*Assistant Examiner* — Arlene Heredia Ocasio
(74) *Attorney, Agent, or Firm* — Lucas & Mercanti, LLP

(57) ABSTRACT

A solid lubricant is supplied to a surface of an image carrier of an electrophotographic image forming apparatus. The solid lubricant contains a fatty acid metal salt and polypropylene, and the polypropylene has an acid value of 1 mg KOH/g or more. The solid lubricant is a solid substance of a melt mold containing the fatty acid metal salt and the polypropylene.

6 Claims, 2 Drawing Sheets

SOLID LUBRICANT, ELECTROPHOTOGRAPHIC IMAGE FORMING APPARATUS, AND IMAGE FORMING METHOD

CROSS-REFERENCE TO RELATED APPLICATIONS

This application claims priority under the Paris Convention of Japanese Patent Application No. 2016-056484 filed on Mar. 22, 2016 with Japan Patent Office, which is incorporated herein by reference in its entirety.

TECHNICAL FIELD

The present invention relates to a solid lubricant, an electrophotographic image forming apparatus, and an image forming method. More specifically, the present invention relates to a solid lubricant which reduces abrasion unevenness to result in suppressing generation of image density unevenness.

BACKGROUND

In the cleaning process, which is a part of an electrophotographic printing process, the untransferred toner is removed from an image carrier. In order to facilitate the removal of the toner by increasing the releasing property of the toner from the image carrier, or in order to decrease abrasion on a surface of the image carrier (photoreceptor) and a cleaning blade used for cleaning the image carrier, it has been disclosed a method of using a fatty acid metal salt as a lubricant. The fatty acid metal salt is scratched with a device such as a coating brush, and the scratched powder is supplied to the surface of the photoreceptor.

However, with the configuration as described above, there may be produced variation of an amount of the supplied lubricant in the longer direction of the photoreceptor. This is caused by the following reason. When there are locally a high crystalline portion and a low crystalline portion inside of the solid fatty acid metal salt, the high crystalline portion has high hardness, and the low crystalline portion has low hardness. An amount of scratching at the low crystalline portion will be large. When the amount of supplying is varied, the amount of coating of the lubricant will be uneven, and the uneven coating of the lubricant will be visually confirmed as image density unevenness.

Patent document 1 (JP-A No. 2007-224137) discloses a method in which a resin fine powder such as an acrylic resin powder or an inorganic powder such as titanium oxide powder is used together with the fatty acid metal salt. By this, the crystal growth of the fatty acid metal salt is suppressed and the uniform hardness is achieved. Thus, the variation of the amount of the supplied lubricant is restrained.

However, the lubricant described in the Patent document 1 exhibited insufficient effect for restraining unevenness of the amount of the supplied lubricant that was generated by detachment of the lubricant from the surface of the photoreceptor. More specifically, the lubricant will be detached when a scratching force is applied to a surface of a photoreceptor drum in the developing-, transferring-, or cleaning step of an electrophotographic process. In particular, at a portion of a high printing ratio having a large amount of toner in the image surface, the scratching force becomes relatively larger compared with a portion of a low printing ratio having a small amount of toner. The lubricant will be easily detached, and there will be produced abrasion unevenness caused by variation of amount of the detached lubricant. As a result, when images having a large difference in printing ratio in the image surface are continuously printed, it will be produced uneven coating of the lubricant on the photoreceptor according to the printing history. Thus, it will be produced a problem that uneven coating of the lubricant will be visually confirmed as image density unevenness.

Against this problem, there is no improving way by using the lubricant of the Patent document 1. In addition, the lubricant will be detached from the photoreceptor by the fine powder that works as an abrasive agent. Consequently, it may generate the case which increases uneven coating of the lubricant caused by uneven abrasion.

SUMMARY

The present invention was done based on the above-described problems and situations. An object of the present invention is to provide: a solid lubricant which reduces abrasion unevenness to result in suppressing generation of image density unevenness; an electrophotographic image forming apparatus; and an image forming method.

The present inventors have made investigation to solve the above-described problems, and have achieved the present invention. It was found the following. When a solid lubricant contains a fatty acid metal salt and polypropylene having a specific acid value, it may provide a solid lubricant enabling to reduce abrasion unevenness of the solid lubricant from a surface of a photoreceptor. As a result, it may provide a solid lubricant which will suppress generation of image density unevenness. Namely, the problems relating to the present invention are solved by the following embodiments.

1. A solid lubricant supplied to a surface of an image carrier of an electrophotographic image forming apparatus, wherein the solid lubricant comprises a fatty acid metal salt and polypropylene, and the polypropylene has an acid value of 1 mg KOH/g or more.

2. The solid lubricant described in the embodiment 1, wherein the solid lubricant contains the polypropylene in an amount of 2 to 25 mass parts with respect to 100 mass parts of the total amount of the polypropylene and the fatty acid metal salt.

3. The solid lubricant described in the embodiments 1 or 2, wherein the polypropylene has an acid value of 45 mg KOH/g or less.

4. The solid lubricant described in any one of the embodiments 1 to 3, wherein zinc stearate is contained as the fatty acid metal salt.

5. An electrophotographic image forming apparatus comprising: an image carrier which is freely rotatable; a charging device; and a toner image transfer device, wherein the electrophotographic image forming apparatus further comprises a lubricant coating device which is placed between the toner image transfer device and the charging device in a rotation direction of the image carrier, the lubricant coating device being used for coating the solid lubricant on a surface of the image carrier, and the lubricant coating device contains: the solid lubricant described in any one of the embodiments 1 to 4; a lubricant coating member for coating the solid lubricant on the surface of the image carrier; and a lubricant supplying member for supplying the solid lubricant to the lubricant coating member, and the lubricant coating member has flexibility and is placed in a manner of freely pressing on the surface of the image carrier.

6. An image forming method comprising: an image carrier charging step; an electrostatic latent image forming step; a toner image carrying step; and a toner image transferring step, wherein the image forming method further comprises a step of forming a lubricant layer on a surface of the image carrier by coating the solid lubricant supplied from the solid lubricant contained in the lubricant coating device; and the lubricant layer is formed with the solid lubricant described in any one of the embodiments 1 to 4.

By the above-described embodiments of the present invention, it will be reduced abrasion unevenness of the solid lubricant from a surface of a photoreceptor. As a result, it may provide a solid lubricant which will suppress generation of image density unevenness. A formation mechanism or an action mechanism of the effect of the present invention is not made clear, but it is supposed to be as follows.

A high-polar portion of polypropylene has affinity to a functional group on a surface of a photoreceptor, and an alkyl group of polypropylene has affinity to an alkyl group of a fatty acid metal salt, respectively. Therefore, by incorporating a fatty acid metal salt and polypropylene having an acid value of 1 mg KOH/g or more into a solid lubricant, it may be obtained an adhesion effect. Thereby the adhesion power of the lubricant to the photoreceptor may be strengthen. Consequently, the abrasion unevenness will be reduced.

DESCRIPTION OF THE PREFERRED EMBODIMENTS

Figure 1:
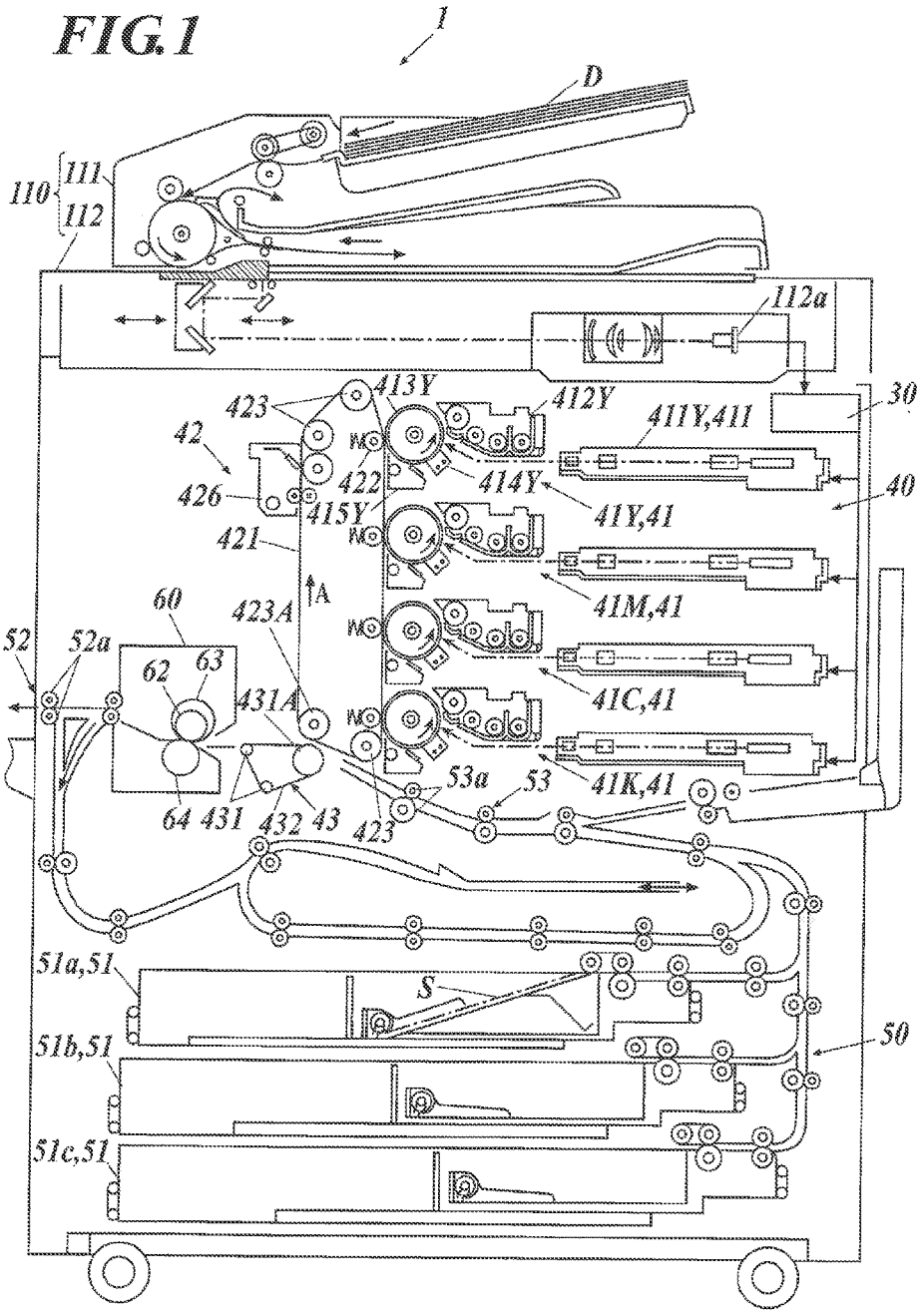
FIG. 1 is a schematic drawing that illustrates an example of a configuration of an image forming apparatus according to the present invention.

A solid lubricant of the present invention is supplied to a surface of an image carrier of an electrophotographic image forming apparatus. The solid lubricant contains a fatty acid metal salt and polypropylene, and the polypropylene has an acid value of 1 mg KOH/g or more. This technical feature is common to the inventions relating to the above-described embodiments.

The solid lubricant of the present invention having this feature enables to produce an effect of reducing abrasion unevenness of the solid lubricant from the surface of the photoreceptor.

It is preferable that the solid lubricant contains the polypropylene in an amount of 2 to 25 mass parts with respect to 100 mass parts of the total amount of the polypropylene and the fatty acid metal salt as an embodiment of the present invention.

In the present invention, it is preferable that the polypropylene has an acid value of 45 mg KOH/g or less. Homogenization of a crystalline degree will be achieved by this.

In the present invention, it is preferable that zinc stearate is contained as the fatty acid metal salt. It may be avoided: the problem of locally insufficient amount of the supplied lubricant when the lubricant is ground with the lubricant coating device; a risk of decreasing a lubricating effect; and a risk of generation of coarse particles.

The solid lubricant of the present invention may be used for an electrophotographic image forming apparatus described in the following.

The electrophotographic image forming apparatus used for the present invention contains: an image carrier which is freely rotatable; a charging device; and a toner image transfer device, wherein the electrophotographic image forming apparatus further contains a lubricant coating device which is placed between the toner image transfer device and the charging device in a rotation direction of the image carrier, the lubricant coating device being used for coating the solid lubricant on a surface of the image carrier, and the lubricant coating device contains: the solid lubricant of the present invention; a lubricant coating member for coating the solid lubricant on the surface of the image carrier; and a lubricant supplying member for supplying the solid lubricant to the lubricant coating member, and the lubricant coating member has flexibility and is placed in a manner of freely pressing on the surface of the image carrier.

The solid lubricant of the present invention may be used for an image forming method described in the following.

The image forming method of the present invention contains: an image carrier charging step; an electrostatic latent image forming step; a toner image carrying step; and a toner image transferring step, wherein the image forming method further contains a step of forming a lubricant layer by coating the solid lubricant supplied from the solid lubricant contained in the lubricant coating device; and the lubricant layer is formed with the solid lubricant of the present invention.

The present invention and the constitution elements thereof, as well as configurations and embodiments to carry out the present invention, will be detailed in the following. In the present description, when two figures are used to indicate a range of value before and after "to", these figures themselves are included in the range as a lowest limit value and an upper limit value respectively.

<<General Outline of Solid Lubricant>>

A solid lubricant of the present invention is supplied to a surface of an image carrier of an electrophotographic image forming apparatus. It contains a fatty acid metal salt and polypropylene, and it is characterized that the polypropylene has an acid value of 1 mg KOH/g or more.

As an electrophotographic image forming apparatus and an image carrier surface according to the present invention, it will be suitably used an electrophotographic image forming apparatus and an image carrier surface described later.

The present inventors consider that the effect of homogenization of crystalline degree (fine dispersion) may be obtained by using a solid lubricant incorporating a fatty acid metal salt and polypropylene having an acid value of 1 mg KOH/g or more. The reason thereof is considered as follows.

Since an alkyl group of polypropylene has high affinity to an alkyl group of a fatty acid metal salt, the fatty acid metal salt tends to be located near to the polypropylene molecule. As a result, polypropylene will behave like a crystal nucleating agent. On the other hand, polypropylene has a helical structure in the molecular chain. Therefore, it has a steric hindrance effect. By the existence of this steric hindrance effect, the growth of crystalline will be suitably restrained.

Consequently, the crystalline will be finely dispersed, and the hardness will be homogenized.

The solid lubricant of the present invention may be obtained by mixing a fatty acid metal salt and polypropylene through melting, then, the mixture is cooled to be solidified in a required shape. For example, the solid lubricant may be produced in a bar shape with a melt molding method by injecting the melt mixture of a fatty acid metal salt and polypropylene into a mold.

[1.1 Fatty Acid Metal Salt]

A fatty acid metal salt according to the present invention may be a known fatty acid metal salt (metal soap) which is used for an image forming apparatus with an electrophotographic method as a lubricant. The fatty acid metal salt may be one kind, or two or more kinds. The fatty acid metal salt is a metal salt of a fatty acid, it may be produced by neutralization of a fatty acid with an alkali compound containing the metal.

Specific examples of a fatty acid and a metal for producing a fatty acid metal salt according to the present invention will be described. Among them, it is preferable to incorporate zinc stearate as a fatty acid metal salt according to the present invention since it is easily extended and it is hard to produce uneven coating thickness.

<1.1.1 Fatty Acid>

Specific examples of a fatty acid are: stearic acid, palmitic acid, myristic acid, lauric acid, oleic acid, and behenic acid. Preferable compounds are fatty acids having a carbon number of 10 to 30, more preferable compounds are fatty acids having a carbon number of 14 to 22 among fatty acids.

When the carbon number is 10 more, an interlayer attraction will be not too strong, and the extending property and crushability of the crystal will not be decreased. As a result, it may be avoided the problem of locally insufficient amount of the supplied lubricant when the lubricant is ground with the lubricant coating device, and a risk of decreasing a lubricating effect.

When the carbon number is 30 or less, an interlayer attraction will be not too small, and brittleness of the lubricant as a whole may be avoided. As a result, a risk of generating coarse particles when the lubricant is ground with the lubricant coating device may be avoided.

Further, it is preferable that the fatty acid according to the present invention has no unsaturated bond.

By using such fatty acid, increase of an interlayer attraction of the crystal caused by the polarity associated with the unsaturated bond will be avoided. As a result, the extending property and crushability of the crystal will not be decreased. Consequently, the problem of locally insufficient amount of the supplied lubricant when the lubricant is ground with the lubricant coating device, and a risk of decreasing a lubricating effect may be avoided.

It is preferable that the fatty acid according to the present invention is stearic acid from the viewpoint of the above-described carbon number and presence or absence of an unsaturated bond. By this, the problem of locally insufficient amount of the supplied lubricant when the lubricant is ground with the lubricant coating device, a risk of decreasing a lubricating effect, and a risk of generation of coarse particles may be avoided.

<1.1.2. Metal>

Examples of a usable metal are: zinc, magnesium, calcium, barium, and lithium.

[1.2. Polypropylene]

Polypropylene according to the present invention has an acid value of 1 mg KOH/g or more. It is preferable that an acid value of propylene is 45 mg KOH/g or less.

When propylene has an acid value of 45 mg KOH/g or less, too strong interaction between the polar groups in polypropylene molecules may be avoided. Thus, avoided the case in which polypropylene molecules tend to gather together may be avoided. As a result, the effect of homogenization of crystal degree without relatively decreasing the interaction between an alkyl group of polypropylene and an alkyl group of a fatty acid metal salt may be achieved.

Since polypropylene according to the present invention has an acid value of 1 mg KOH/g or more, a high-polar portion of polypropylene has affinity to functional group on a surface of a photoreceptor, and an alkyl group of polypropylene has affinity to an alkyl group of a fatty acid metal salt. As a result, an adhesion effect between the fatty acid metal salt and the photoreceptor may be obtained. Thereby, uneven coating amount caused by detachment of the lubricant from the photoreceptor may be decreased. Consequently, generation of image density unevenness may be restrained.

An acid value according to the present invention defined as an amount (in mg) of KOH required for neutralizing 1 g of sample (polypropylene). An acid value may be determined by the test method defined in JIS K0070.

<1.2.1. Production Method of Modified Polypropylene>

Examples of a production method of a modified polypropylene are as follows. One method is to modify a polypropylene resin by making graft polymerization with maleic anhydride (in order to distinguish from the polypropylene of the present invention, polypropylene before giving polarity is called as "a polypropylene resin"). Another method is to make an acid modified polypropylene by making co-polymerization of propylene with acrylic acid, methacrylic acid, or maleic anhydride. By using these methods, it may be achieved to give polarity (a polar portion) to a polypropylene resin.

Examples of a usable polypropylene resin which is given polarity (a polar portion) are: polypropylene homopolymer; and polypropylene copolymer such as ethylene-propylene random copolymer, ethylene-propylene block copolymer, ethylene-α-propylene copolymer, and propylene-α-propylene copolymer.

In order to effectively obtain the effect of homogenization of crystal degree by the steric hindrance of a helix structure of a polypropylene molecule, it is preferable to use polypropylene homopolymer.

<1.2.2. Adjusting Method of Acid Value>

Adjustment of an acid value may be done by controlling the adding ratio of the monomer (such as maleic anhydride, acrylic acid, and methacrylic acid, used for graft polymerization or co-polymerization) to the polypropylene resin. A required acid value may be obtained.

<1.2.3. Preferred Amount of Polypropylene in Solid Lubricant>

It is preferable that the solid lubricant of the present invention contains the polypropylene in an amount of 2 to 25 mass parts with respect to 100 mass parts of the total amount of the polypropylene and the fatty acid metal salt. More preferably, it is contained in an amount of 3 to 20 mass parts. And still more preferably, it is contained in an amount of 3 to 12 mass parts.

When the contained amount of the polypropylene is 2 mass parts or more with respect to the mass of the solid lubricant, a sufficient adhesion force to the surface of the photoreceptor may be obtained. When the contained amount of the polypropylene is 25 mass parts or less, the effect of steric hindrance of polypropylene will not be increased too much. As a result, it may be avoided too much crystallization of the fatty acid metal salt, and it may be also avoided brittleness of the lubricant as a whole, and generation of coarse particles.

Polypropylene itself has a lower hardness than the fatty acid metal salt. However, when the contained amount of the polypropylene is 25 mass parts or less, the hardness of the lubricant as a whole will not be decreased too much. As a result, it may be avoided too much abrasion amount of the lubricant. On the other hand, since polypropylene has a strong effect of homogenizing crystal degree of the fatty acid metal salt, a small amount of 2 mass parts will be efficient for obtaining an effect of decreasing unevenness of the abrasion amount of the lubricant. Consequently, it is preferable that the solid lubricant of the present invention contains the polypropylene in an amount of 2 to 25 mass parts with respect to 100 mass parts of the total amount of the polypropylene and the fatty acid metal salt. By this added amount, a required effect without generating decrease of hardness and increase of abrasion amount of the lubricant may be achieved.

<1.2.4. Preferred Physical Property of Polypropylene>

A preferable number average molecular weight of polypropylene is in the range of 1,000 to 40,000. When a number average molecular weight of polypropylene is 1,000 or more, polypropylene is not fused to the photoreceptor during the operation of the image forming apparatus, and the coating thickness of the solid lubricant will be constant. On the other hand, when a number average molecular weight of polypropylene is 40,000 or less, the movement of the polar group in the polypropylene molecule will not be restrained, and the case of yielding too small interaction of the polypropylene with the polar group on the surface of the photoreceptor may be avoided. Thereby, sufficient adhesion force of polypropylene towards the photoreceptor may be achieved.

A preferable melting point of the polypropylene is in the range of 110 to 170° C. When the melting point of the polypropylene 110° C. or more, the polypropylene is not fused to the photoreceptor during the operation of the image forming apparatus, and the coating amount of the solid lubricant will be made to be constant. On the other hand, when the inciting point of the polypropylene is 170° C. or less, the movement of the polar group in the polypropylene molecule will not be restrained, and of yield too small interaction of the polypropylene with the polar group on the surface of the photoreceptor may be avoided. Thereby, sufficient adhesion force of polypropylene towards the photoreceptor may be achieved. More preferably, the melting point of the polypropylene is in the range of 120 to 160° C.

<<2. Electrophotographic Image Forming Apparatus and Image Forming Method>>

It will be described an image forming method of the present invention by using an electrophotographic image forming apparatus adopted with the image forming method of the present invention.

An image forming method according to the present invention contains: an image carrier charging step; an electrostatic latent image forming step; a toner image carrying step; and a toner image transferring step. It is preferable that the image forming method further contains a step of forming a lubricant layer on a surface of an image carrier by coating the solid lubricant supplied from the solid lubricant contained in the lubricant coating device; and the lubricant layer is formed with the solid lubricant of the present invention.

The electrophotographic image forming apparatus (hereafter, it may be simply called as "an image forming apparatus") according to the present invention contains: an image carrier which is freely rotatable; a charging device; and a toner image transfer device. It is preferable that the electrophotographic image forming apparatus further contains a lubricant coating device which is placed between the toner image transfer device and the charging device in a rotation direction of the image carrier, the lubricant coating device being used for coating the solid lubricant on a surface of the image carrier. The image forming apparatus as described above may be configured in the same way as the known image forming apparatus except for the lubricant coating device.

It is preferable that the lubricant coating device according to the present invention contains: the solid lubricant of the present invention; a lubricant coating member for coating the solid lubricant on the surface of the image carrier; and a lubricant supplying member for supplying the solid lubricant to the lubricant coating member, and the lubricant coating member has flexibility and is placed in a manner of freely pressing on the surface of the image carrier. The lubricant coating device as described above may be configured in the same way as the known lubricant coating device (apparatus) except for using the solid lubricant of the present invention as a solid lubricant.

It is preferable that an image forming method used for the embodiments of the present invention has the following feature. The image forming method contains the steps of: charging an image carrier (an image carrier charging step); forming an electrostatic latent image on the charged image carrier (an electrostatic latent image forming step); making the image carrier to carry a toner image by supplying a toner on the image carrier which has been formed with the electrostatic latent image thereon (a toner image carrying step); and transferring the toner image carried by the image carrier to a transferring material (a toner image transferring step). The image forming method further contains a step of forming a lubricant layer on the surface of the image carrier after transferring the toner image by coating the solid lubricant supplied from the solid lubricant contained in the lubricant coating device; and the lubricant layer is formed with the solid lubricant of the present invention. The image forming method as described above may be used in the same way as the known image forming method with electrophotographic method except for using the solid lubricant of the present invention as a solid lubricant.

In the following, an image forming apparatus and an image forming method according to the present invention will be described by referring to figures.

An image forming apparatus 1 illustrated in FIG. 1 includes an image reading section 110, an image processing section 30, an image forming section 40, a sheet conveyance section 50, and a fixing device 60.

The image forming section 40 contains image forming units 41Y, 41M, 41C, and 41K each forming an image of each color of Y(yellow), M(magenta), C(cyan), and K(Black). Since these units each have the same composition except the incorporated toner, the symbol designating the color may be omitted hereafter. The image forming section 40 further contains an intermediate transfer unit 42 and a secondary transfer unit 43. These correspond to a toner image transfer device.

Each of the image forming units 41 includes an exposure device 411, a developing device 412, a photoreceptor drum 413, a charging device 414 for charging, and a cleaning device 415 that is described later. The photoreceptor drum 413 is a negatively-charged organic photoreceptor, for example. The surface of the photoreceptor drum 413 has a photoconductive property. The photoreceptor drum 413 corresponds to an image carrier.

The charging device 414 is a corona discharge generator, for example. The charging device 414 may be a contact charging device which contacts with the photoreceptor drum 413 through a contact charging member such as a charging roller, a charging brush, or a charging blade to result in charging. The exposure device 411 includes a semi-conductor laser as a lighting source, and a light polarization device (polygon motor) that irradiates laser light to the photoreceptor drum 413 in accordance with the image to be formed.

The developing device 412 is a device using a two-component developing method. The developing device 412 contains: a developing container that contains a two-component developer, a developing roller (a magnetic roller) rotatably placed at the opening portion of the developing container, a partition that divides the inside of the developing container in a way that the two-component developer may communicate, a transport roller for transporting the two-component developer at the opening side of the developing container toward the developing roller, and a mixing roller that mixes the two-component developer in the developing container. The developing container contains the above-described toner as a two-component developer.

The intermediate transfer unit 42 includes an intermediate transfer belt 421, a primary transfer roller 422 that presses the intermediate transfer belt 421 to the photoreceptor drum 413, a plurality of support rollers 423 including a backup roller 423A, and a belt cleaning device 426. The intermediate transfer belt 421 is stretched in a loop state over a plurality of support rollers 423. Rotation of at least one driving roller among the plurality of support rollers 423 causes the intermediate transfer belt 421 to run in the direction indicated by an arrow A at a constant speed.

In the image forming apparatus 1 illustrated in FIG. 1, the primary transfer roller 422 corresponds to a toner image transfer device, and the intermediate transfer belt 421 corresponds to a transferring material.

The secondary transfer unit 43 contains: a secondary transfer belt 432 having an endless shape, and a plurality of support rollers 431 including a secondary transfer roller 431A. The secondary transfer belt 432 is stretched in a loop state by the secondary transfer roller 431A and the support rollers 431.

A cleaning device 415 contains: a cleaning container 415A having a opening to a photoreceptor drum 413; and a cleaning blade 415B that is located to abut the surface of the photoreceptor 413. The cleaning blade 415B is an elastic blade made of rubber, for example.

The cleaning container 415A contains: a rotating brush 416A that abuts the surface of the photoreceptor drum 413; a solid lubricant 416B that abuts the surface of the rotating brush 416A; and a pressing device 416C that pushes the solid lubricant 416B to the rotating brush 416A. The rotating brush 416A, the solid lubricant 416B, and the pressing device 416C are located in a space between the toner image transfer device and the charging device in a rotation direction of the image carrier. They correspond to a lubricant coating device 416 that applies a lubricant to the surface of the photoreceptor drum 413 being an image carrier.

The solid lubricant 416B is a solid lubricant according to the present invention. The solid lubricant 416B is produced with a melt mold method, for example. The shape of the solid lubricant 416B is suitably determined within the range that permits to apply the lubricant on the surface of the photoreceptor drum 413. For example, it is a cuboid having about the same length as an axial length of the rotating brush 416A.

The rotating brush 416A is configured to be freely rotatable in a forward direction or a reverse direction to the photoreceptor drum 413. The rotating brush 416A is not limited in particular as long as it can apply a solid lubricant on the surface of the image carrier. For example, it may be cited a rotating brush composed of a freely rotatable ax made of a metal and a plurality of flexible capillary materials made of a resin. This rotating brush 416A has flexibility and it corresponds to a lubricant coating member that is located to abut freely the surface of the image carrier.

The pressing device 416C is a member that pushes the solid lubricant 416B to the rotating brush 416A. For example, it is a flexible member of a coil or a blade spring. The pressing device 416C corresponds to a lubricant supplying member for supplying the solid lubricant to the lubricant coating member.

The fixing device 60 includes: a fixing roller 62, a heating belt 63 of an endless belt that covers the outer peripherical surface of the fixing roller 62 so as to heat and melt the toner constituting the toner image on a sheet S, and a pressure roller 64 that presses the sheet S to the fixing roller 62 and the heating belt 63. The sheet S corresponds to a recording medium.

The image forming apparatus 1 further includes the image reading section 110, the image processing section 30, and the sheet conveyance section 50. The image reading section 110 includes a sheet feeding device 111 and a scanner 112. The sheet conveyance unit 50 includes a sheet feeding section 51, a sheet output section 52, and a sheet pathway section 53. Three sheet feeding tray units 51*a* to 51*c* that constitute the sheet feeding section 51 each respectively contain the predetermined sheets S (a standard sheet and a special sheet) identified based on the weight and the size. The sheet pathway section 53 contains a plurality of transport roller pairs such as a pair of register rollers 53*a*.

An image forming process with the image forming apparatus 1 will be described. The image forming method with the image forming apparatus 1 contains the following steps of: charging a photoreceptor drum 413 (an image carrier charging step); forming an electrostatic latent image on the charged photoreceptor drum 413 (an electrostatic latent image forming step); making the photoreceptor drum 413 formed with the electrostatic latent image thereon to carry an toner image by a toner supplying thereto (a toner image carrying step); transferring the toner image carried by the photoreceptor drum 413 to a transferring material (a toner image transferring step); and forming a lubricant layer by applying a lubricant supplied from the solid lubricant 416B on the surface of photoreceptor drum 413 after transferring the toner image.

At first, the scanner 112 reads a draft D on a contact glass through optical scanning. The reflective light from the draft D is read by a CCD sensor 112*a*. This reflective light becomes an input image data. The input image data is subjected to a predetermined image processing in the image processing section 30, and it is sent to the exposure device 411.

The photoreceptor drum 413 rotates with a predetermined peripheral speed. The charging device 414 uniformly charges the surface of the photoreceptor drum 413 with a negative polarity. In the exposure device 411, a polygon mirror of the polygon motor rotates with a high speed. The laser light corresponding to the input image data of each color component is moved along with the axis direction of the photoreceptor drum 413. The laser light is irradiated in the axis direction of the outer peripherical surface of the photoreceptor drum 413. Thus, an electrostatic latent image is formed on the surface of the photoreceptor drum 413.

In the developing device 412, the toner particles are charged by mixing and transporting of the two-component developer in the developer container. The two-component developer is transported to the developing roller, and it forms a magnetic brush on the developing roller. The charged toner particles electrostatically adhere to the electrostatic latent image portion on the surface of the photoreceptor drum 413. In this way, the electrostatic latent image on the surface of the photoreceptor drum 413 is visualized. It is formed a toner image corresponding to the electrostatic latent image on the surface of the photoreceptor drum 413.

The toner image on the surface of the photoreceptor drum 413 is transferred to the intermediated transfer belt 421 in the intermediate transfer unit 42. The intermediate transfer belt 421 is pressed against the respective photoreceptor drum 413 through the primary transfer roller 422. As a result, there are formed primary transfer nip parts for each photoreceptor drum by the photoreceptor drum 413 and the intermediate transfer belt 421. In the primary transfer nip part, each toner image is sequentially transferred to the intermediate transfer belt 421.

Fine powder lubricant is supplied and coated on the surface of the photoreceptor drum 413 after transferring the image. The fine powder lubricant is prepared by grinding the solid lubricant 416B with the rotating brush 416A that is pressed to the solid lubricant 416B.

The solid lubricant incorporates the polypropylene. This polypropylene has: a suitable nuclei-forming effect through the property of having affinity to an alkyl group of a fatty acid metal salt; and a suitable steric hindrance effect through the property of having a helical structure in the molecule. By these effects, variation of the crystal degree and the hardness of the solid lubricant will be restrained. As a result, the solid lubricant will be ground uniformly by the rotating brush 416A, and the ground lubricant will be adhered to the surface of the photoreceptor drum 413.

The portion of the surface of the photoreceptor drum 413 which is coated with the lubricant reaches the cleaning blade 415B. The remaining toner after-transfer and an excessive lubricant on the surface of the photoreceptor drum 413 will be scratched off by the cleaning blade 415B. They are recovered in the container (cleaning step). Thus the remaining toner after-transfer is removed from the surface of the photoreceptor drum. The lubricant is extended on the surface and a lubricant layer is formed. By the formation of the lubricant layer, the adhesion force between the toner and the photoreceptor drum 413 is decreased. The scratching property of the toner will be improved, and the cleaning deficiency will be restrained.

By coating the lubricant on the surface of the photoreceptor, the friction between the cleaning blade 415B pressed to the surface and the surface of the photoreceptor drum 413 is decreased within the whole range of the pressed long direction of the cleaning blade 415B. Therefore, the abrasion of the cleaning blade 415B is restrained, and the abrasion of the photoreceptor drum 413 is also restrained.

In the above-described cleaning step, in the image portion of toner printing, the transfer-remaining toner reaches the cleaning blade. The surface of the photoreceptor drum 413 is scratched by the scratched toner with the cleaning blade 415B or by the external additive removed from the toner. The lubricant is detached by this. On the other hand, in the non-image portion having no transfer-remaining toner, the above-described scratch is not generated. Therefore, the abrasion force to detach the lubricant will be varied depending on the difference of image density in a longer direction. This variation will became a primary factor to produce uneven coating thickness of the lubricant.

However, the lubricant according to the present invention contains polypropylene having an acid value, and this polypropylene has an adhesion property to the surface of the photoreceptor drum. As a result, the detachment of the lubricant in the image portion is restrained, and uneven coating thickness of the lubricant is decreased.

On the other hand, the secondary transfer roller 431A is pressed against the backup roller 423A through the intermediate transfer belt 421 and the secondary transfer belt 432. There is formed a secondary transfer nip part by the intermediate transfer belt 421 and the secondary transfer belt 432. The sheet S passes through the secondary transfer nip part. The sheet S is transported to the secondary transfer nip part by the sheet conveyance section 50. The correction of an inclination of the sheet S and adjustment of the timing of the transport are done in the register roller section located with a pair of register rollers 53*a*.

When the sheet S is transferred to the secondary transfer nip part, a bias voltage for transfer is applied to the secondary transfer roller 431A. By application of the bias voltage for transfer, the toner images held on the intermediate transfer belt 421 are transferred onto the sheet S. The sheet S on which the toner images have been transferred is conveyed to the fixing device 60.

The fixing device 60 forms a fixing nip part by the heating belt 63 and the pressure roller 64. The conveyed sheet S is heated and pressed in the fixing nip part. The toner particles constituting the toner image of the sheet S are heated. As a result, the whole toner particles melt, and the toner component adheres to the sheet S. The whole melted toner components are rapidly solidified. In this manner, the toner image is fixed on the sheet S. The sheet S having a fixed image is ejected outside the apparatus through the sheet output section 52 equipped with a sheet output roller 52*a*. Thus, it is formed a high quality image.

The transfer-remaining toner on the surface of the intermediate transfer belt 421 after the secondary transfer is removed by the belt cleaning device 426 having a belt cleaning blade that slidably contacts with the surface of the intermediate transfer belt 421.

An image forming apparatus and an image forming method according to the present invention contain the above-described configuration. As a result, the uneven abrasion from the surface of the photoreceptor is decreased. The solid lubricant of the present invention may restrain the image density unevenness. Consequently, generation of image density unevenness is restrained.

The applicable embodiments of the present invention are not limited to the above-described embodiments. It may be suitably changed within the scope of not deviating the intended meaning of the present invention.

Figure 2A:
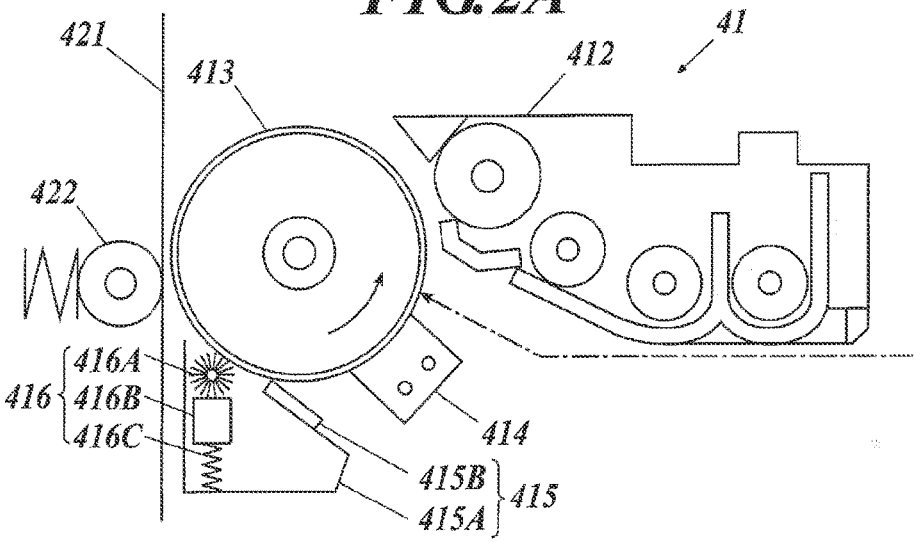
FIG. 2A is a schematic drawing that illustrates an example of a configuration of a lubricant coating device according to the present invention.
Figure 2B:
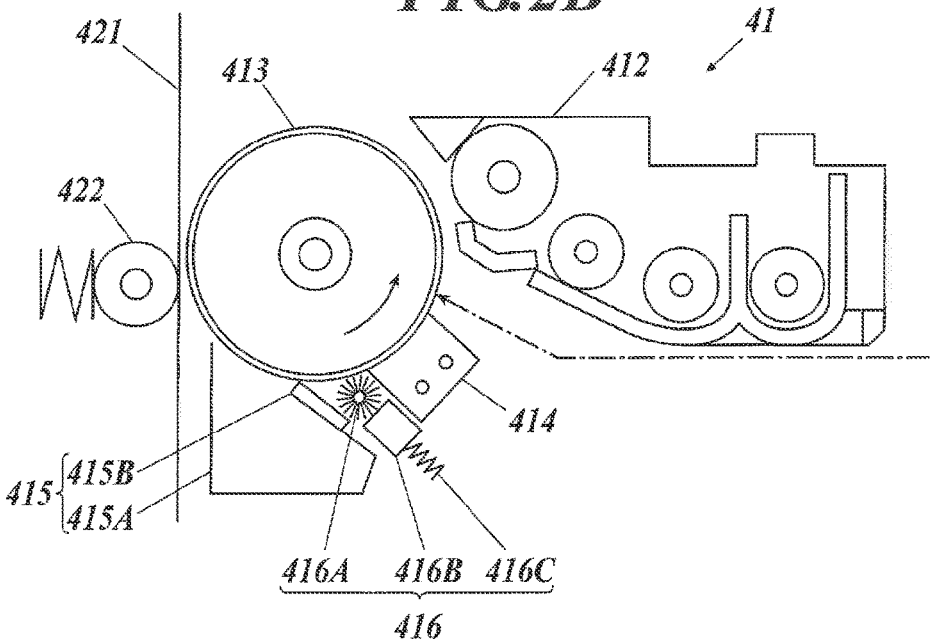
FIG. 2B is a schematic drawing that illustrates an example of a configuration of a lubricant coating device according to the present invention.

For example, the image forming apparatus 1 is not limited to the above-described apparatus. Specifically, the image forming apparatus 1 has the lubricant coating device 416 just before the cleaning blade 415B with respect to the rotating direction of the photoreceptor drum. That is, it may be placed in a position between the transfer device (primary transfer roller 422) and the cleaning blade 415B. However, as illustrated in FIG. 2B, it may be placed in a position just after the cleaning blade 415B. That is, it may be placed in a position between the cleaning blade 415B and the charging device 414. The lubricant coating device 416 may be placed in a position between the toner image transfer device and the cleaning device 415 as illustrated in FIG. 2A. Otherwise, it may be placed in a position between the cleaning device 415 and the charging device 414 as illustrated in FIG. 2B.

When the lubricant coating device 416 is placed in a position as illustrated in FIG. 2B, the lubricant coating device may further has a device to make even the coated lubricant located in a position for pressing to the surface of the photoreceptor drum 413. Examples of such device are: an elastic brush, an elastic belt, and an elastic roller.

When the configuration is as illustrated in FIG. 2B, the lubricant is coated after scratching the remaining toner after-transfer with the cleaning blade 415B. Therefore, the lubricant may be uniformly coated on the surface of the photoreceptor without being affected by the remaining toner after-transfer. On the other hand, the lubricant coated on the surface of the photoreceptor drum 413 passes through the developing device 412 and the primary transfer nip portion before reaching the leaning blade 415B. The lubricant is scratched during the passage, and the lubricant may be detached from the surface of the photoreceptor drum 413. From the viewpoint of reducing the image density unevenness caused by the uneven amount of detachment (abrasion unevenness), the configuration described in FIG. 2A is more preferable.

However, against the scratch during passing through the developing device 412 and the primary transfer nip portion in the configuration described of FIG. 2B, the lubricant according to the present invention contains polypropylene having a specific acid value. Since the polypropylene has an adhesion property to the surface of the photoreceptor drum 413, the abrasion of the lubricant is restrained and it may be obtained an effect of reducing the coating thickness unevenness.

The rotating brush 416A may be a member which supplies the lubricant from the solid lubricant 416B by pressing to the surface of the photoreceptor drum 413. Examples of such member are an elastic belt and an elastic roller. It may be other coating member which is capable of coating the lubricant on the surface of the photoreceptor drum 413. Further, the rotating brush 416A and other coating member may be located in a position to abut the surface of the photoreceptor drum 413 only during the coating operation.

In the above-described image forming apparatus 1, the solid lubricant 416B was described as a cuboid lump molded as one body. The solid lubricant is not limited to a cuboid, it may have any shape as long as it may be coated on the surface of the photoreceptor drum 413.

EXAMPLES

Hereinafter, specific examples of the present invention will be described, but the present invention is not limited thereto. In the present examples, the description of "parts" or "%" is used, it represents "mass parts" or "mass %" unless specific notice is given.

[1. Preparation of Solid Lubricant]

<1.1. Solid Lubricant of Inventive Example 1>

The following components were mixed with the amount indicated to prepare a first mixture. The mixture was blended by using a "Henschel mixer" (Nippon Coke & Engineering Co., Ltd.) with a rotary blade circumferential speed of 35 m/sec at 32° C. for 3 minutes.

| | |
|---|---|
| Fatty acid metal salt | 950 mass parts |
| Polypropylene (indicated as "Additive" in Table 1) | 50 mass parts |

Zinc stearate (zinc stearate G, made by NOF Corporation) was used as a fatty acid metal salt. Maleic anhydride modified polypropylene (A-C 1325P, made by Honeywell Japan, Inc.) was used as polypropylene.

Subsequently, the first mixture was poured into a mold whose internal temperature had been raised to 150° C. in advance with a care of not decreasing the temperature to less than 145° C. Then, the mold was left still with keeping the internal temperature of the mold to be 150° C. for 30 minutes. Next, the mold was cooled to room temperature (25° C.) with a decreasing rate of 1° C./min while paying attention so that temperature unevenness does not occur. The solid substance of the melt mold composed of the above-described materials was taken out from the mold. Thus it was obtained a solid lubricant having a size of 8 mm (height)×11 mm (width)×328 mm (length).

<1.2. Solid Lubricants of Inventive Examples 2 to 9 and Comparative Examples 1 to 4>

Solid lubricants of inventive examples 2 to 9 and comparative examples 1 to 4 were prepared in the same manner as preparation of the solid lubricants of the inventive example 1 except that the added amount and the type of the fatty acid metal salt and the additive were changed as described in Table 1.

Daiwax OZ (made of Dainichi Chemical Co., Ltd.) was used as zinc oleate of Inventive example 9.

TABLE 1

| | Fatty acid metal salt | | Additive | | | | |
|---|---|---|---|---|---|---|---|
| | Kind | Added amount (mass parts) | Kind | Acid value (mg KOH/g) | Added amount (mass parts) | Manufacturer | Product name |
| Inv. Example 1 | Zinc stearate | 950 | Polypropylene | 18 | 50 | Honeywell Japan, Inc. | A-C 1325P |
| Inv. Example 2 | | 700 | | | 300 | | |
| Inv. Example 3 | | 750 | | | 250 | | |
| Inv. Example 4 | | 980 | | | 20 | | |
| Inv. Example 5 | | 990 | | | 10 | | |
| Inv. Example 6 | | 950 | | 3 | 50 | Sanyo Chemical Industries, Ltd. | Umex 100TS |
| Inv. Example 7 | | 950 | | 41 | 50 | Clariant Japan K.K. | Licocene PP MA 7452 |

TABLE 1-continued

| | Fatty acid metal salt | | Additive | | | | |
|---|---|---|---|---|---|---|---|
| | Kind | Added amount (mass parts) | Kind | Acid value (mg KOH/g) | Added amount (mass parts) | Manufacturer | Product name |
| Inv. Example 8 | | 950 | | 50 | 50 | Honeywell Japan, Inc. | A-C 596P |
| Inv. Example 9 | Zinc oleate | 950 | | 18 | 50 | Honeywell Japan, Inc. | A-C 1325P |
| Comp. Example 1 | Zinc stearate | 950 | Acrylic resin | 0 | 50 | Ohashi Chemical Industries, Ltd. | POLYNAL No. 500 |
| Comp. Example 2 | | 950 | Acrylic resin | 4 | 50 | Soken Chemical & Engineering Co. Ltd. | THERMOLAC EF-42 |
| Comp. Example 3 | | 950 | Titanium oxide | — | 50 | Sakai Chemical Industries Co. Ltd. | A110 |
| Comp. Example 4 | | 950 | Polypropylene | 0 | 50 | Honeywell Japan, Inc. | A-C 1754 |

Inv. = Inventive,
Comp. = Comparative

[2. Evaluation Method and Measuring Method]

The prepared solid lubricants of the inventive examples 1 to 9 and the comparative examples 1 to 4 were used for evaluation. The image quality (image density unevenness) was evaluated with the method described in <2.1. Evaluation of Image density unevenness> as indicated below.

An uneven supplied amount of the lubricant (uneven scratch amount) and uneven abrasion were evaluated with the methods described in <2.2. Evaluation of uneven supplied amount of lubricant> and <2.3. Evaluation of uneven abrasion amount of lubricant> as indicated below. These are supposed to be factors to produce image density unevenness.

<2.1. Evaluation of Image Density Unevenness>

The evaluation of image memory was done using a commercial image forming apparatus (Bizhub™ PRESS C1100; made of Konica Minolta Inc.) loaded with solid lubricants of the inventive examples 1 to 9 and the comparative examples 1 to 4. The evaluation was done under the conditions of temperature 20° C. and humidity 50% RH. The printing was performed as indicated below, and evaluation was done based on the printed image.

An image chart was printed a recording medium A (J-paper having a size of A3; made by Konica Minolta Inc.). The image chart was composed of a cyan image having a print ratio 100% in a left half-portion and an image having a print ratio 0% in a right half-portion of the recording medium A with respect to the conveying direction of the recording medium. (Hereafter, this image chart may be called as "an image chart A".) One hundred (100) sheets of recording medium A having both-side printing were produced by using the solid lubricants of the inventive examples 1 to 9 and the comparative examples 1 to 4.

Then, an image chart was printed a recording medium B (POD gloss coat paper; 128 g/m$^2$). The image chart was a half-tone image of a cyan image having a print ratio 40% on the whole surface of one sheet of recording medium B. (Hereafter, this image chart may be called as "an image chart B".)

In the last step, in the recording medium B which has been printed with the image chart B, the portion corresponding to print ratio 100% of the image chart A, and the portion corresponding to print ratio 0% of the image chart A were examined to detect whether there was a density difference of the print image between these two portions or not.

The solid lubricants of the inventive examples 1 to 9 and the comparative examples 1 to 4 were evaluated according to the following criteria. With respect to an evaluation of image density unevenness, the tests were respectively done two times for the solid lubricants of the inventive examples 1 to 9 and the comparative examples 1 to 4. The average ranks obtained by two examinations are listed in Table 2.

Rank 5: Conformity with the requirement. No image density unevenness of the print image is detected by observing a magnified print image with a microscope having a magnification of 20 times.

Rank 4: Conformity with the requirement. No image density unevenness of the print image is detected by visual inspection. However, the image density unevenness is detectable to a magnified print image observed with a microscope having a magnification of 20 times.

Rank 3: Conformity with the requirement. No image density unevenness of the print image is detected by usual visual inspection. The image density unevenness is detectable when the recording medium B is placed directly under a fluorescent light, and when the image is carefully observed from about 10 degree diagonally upward direction at a close distance.

Rank 2: Nonconformity with the requirement. The image density unevenness of the print image is detectable by visual inspection when the recording medium B is observed at any angle.

Rank 1: Nonconformity with the requirement. The image density unevenness of the print image is easily detectable by visual inspection.

<2.2. Evaluation of Uneven Supplied Amount of Lubricant>

Under the same image printing conditions used for evaluation of the Image density unevenness, one thousand (1000) sheets of white prints were printed with both-side printing instead of printing one hundred (100) sheets of prints of chart A with both-side printing. Here, the image chart B was not printed.

After performing the above-described printing, the photoreceptor was detached from the image forming apparatus, and the thickness of the surface of the photoreceptor was measured. The measurement was done at 151 points with a space of 2 mm in the longer direction of the center portion of 300 mm in the photoreceptor.

When the coating thickness unevenness, which will result in uneven supplied amount of lubricant, is small, the difference of coating thickness at the 151 points was expected to be small. Therefore, the following CV value was used for evaluation.

CV value(Coefficient of Variation)(%)=[(Standard deviation of the measurement at the 151 points)/(Average value of the measurement at the 151 points)]×100

When the CV value was 5% or less, it was judged to pass inspection. In table 2, the CV value was described as "uneven supplied amount of lubricant (%)".

<2.3. Evaluation of Uneven Abrasion Amount of Lubricant>

Evaluation of the coating thickness unevenness was done as follows. After printing an image chart A on one hundred (100) sheets of the recording medium A by using the solid lubricants of the inventive examples 1 to 9 and the comparative examples 1 to 4, the surface of the photoreceptor was measured. The difference of the lubricant layer thickness between the portion of 100% print ratio in the image chart A and the portion of 0% print ratio was detected with measurement of absorbance.

The evaluation of the thickness was done as follows.

After performing the above-described 100 sheets of printing, the photoreceptor was detached from the image forming apparatus. Then, an absorbance of the surface of the photoreceptor was measured with a reflective spectrophotometer (FE-3000, made by Otsuka Electronics Co., Ltd.). The measurement was done at 76 points with a space of 2 mm in the range of 150 mm, starting at 2 mm from the center of the photoreceptor in the longer direction to the edge portion of the photoreceptor. The average value was determined as an absorbance in the portion having the print ratio of 100%, or an absorbance in the portion having the print ratio of 0%.

When the decreased amount of absorbance in the portion having the print ratio of 0% with respect to the absorbance in the portion having the print ratio of 100% portion is small, it means that the effect of decreased layer thickness by scratching is small, and the coating thickness unevenness is small. It was decided that the case satisfying the following scheme was conformed to the requirement.

(Absorbance in the portion corresponding to the print ratio of 100%/Absorbance in the portion corresponding to the print ratio of 0%)×100>50 (%)

TABLE 2

| | Image density unevenness | Uneven supplied amount of lubricant (%) | Uneven abrasion amount of lubricant (%) |
|---|---|---|---|
| Inv. Example 1 | 5.0 | 1.5 | 90 |
| Inv. Example 2 | 3.5 | 4.9 | 94 |
| Inv. Example 3 | 4.0 | 3.7 | 93 |
| Inv. Example 4 | 4.0 | 2.5 | 70 |
| Inv. Example 5 | 3.0 | 3.8 | 57 |
| Inv. Example 6 | 4.5 | 2.1 | 66 |
| Inv. Example 7 | 4.5 | 2.6 | 94 |
| Inv. Example 8 | 4.0 | 3.9 | 95 |
| Inv. Example 9 | 4.5 | 2.4 | 82 |
| Comp. Example 1 | 1.0 | 3.2 | 32 |
| Comp. Example 2 | 2.0 | 3.1 | 42 |
| Comp. Example 3 | 1.0 | 3.4 | 27 |
| Comp. Example 4 | 2.0 | 2.2 | 29 |

Inv. = Inventive,
Comp. = Comparative

DESCRIPTION OF SYMBOLS

1: Image forming apparatus
30: Image processing section
40: Image forming section
41, 41Y, 41M; 41C, and 41K: Image forming unit
42: Intermediate transfer unit
43: Secondary transfer unit
50: Sheet conveyance section
51: Sheet feeding section
51*a*, 51*b*, and 51*c*: Sheet feeding tray unit
52: Sheet output section
52*a*: Sheet output roller
53: Sheet pathway section
53*a*: Pair of register rollers
60: Fixing device
62: Fixing roller
63: Heating belt
64: Pressure roller
110: Image reading section
111: Sheet feeding device
112: Scanner
112*a*: CCD sensor
411 (411Y): Exposure device
412 (412Y): Developing device
413 (413Y): Photoreceptor drum
414 (414Y): Charging device
415 (415Y): Cleaning device
415A: Cleaning container
415B: Cleaning blade
416: Lubricant coating device
416A: Rotating brush
416B: Solid lubricant
416C: Pressing device
421: Intermediated transfer belt
422: Primary transfer roller
423 and 431: Support roller
423A: Backup roller
426: Belt cleaning device
431A: Secondary transfer roller
432: Secondary transfer belt
D: Draft
S: Sheet

What is claimed is:

1. A solid lubricant supplied to a surface of an image carrier of an electrophotographic image forming apparatus,
wherein the solid lubricant comprises a fatty acid metal salt and polypropylene,
the solid lubricant is a solid substance of a melt mold comprising the fatty acid metal salt and the polypropylene, and
the polypropylene has an acid value of 1 mg KOH/g or more.

2. The solid lubricant described in claim 1,
wherein the solid lubricant contains the polypropylene in an amount of 2 to 25 mass parts with respect to 100 mass parts of the total amount of the polypropylene and the fatty acid metal salt.

3. The solid lubricant described in claim 1,
wherein the polypropylene has an acid value of 45 mg KOH/g or less.

4. The solid lubricant described in claim 1,
wherein zinc stearate is contained as the fatty acid metal salt.

5. An electrophotographic image forming apparatus comprising: an image carrier which is freely rotatable; a charging device; and a toner image transfer device,
wherein the electrophotographic image forming apparatus further comprises a lubricant coating device which is placed between the toner image transfer device and the charging device in a rotation direction of the image carrier, the lubricant coating device being used for coating the solid lubricant on a surface of the image carrier, and
the lubricant coating device contains: the solid lubricant described in claim 1; a lubricant coating member for coating the solid lubricant on a surface of the image carrier; and a lubricant supplying member for supplying the solid lubricant to the lubricant coating member, and the lubricant coating member has flexibility and is placed in a manner of freely pressing on the surface of the image carrier.

6. An image forming method comprising: an image carrier charging step; an electrostatic latent image forming step; a toner image carrying step; and a toner image transferring step, wherein the image forming method further comprises a step of forming a lubricant layer on a surface of an image carrier by coating the solid lubricant supplied from the solid lubricant in a lubricant coating device; and the lubricant layer is formed with the solid lubricant described in claim 1.

* * * * *